US006840222B2

(12) United States Patent
Schilling et al.

(10) Patent No.: US 6,840,222 B2
(45) Date of Patent: Jan. 11, 2005

(54) METHOD AND DEVICE FOR MONITORING A FUEL SYSTEM OF AN INTERNAL COMBUSTION ENGINE

(75) Inventors: Stephan Schilling, Murr (DE); Wolfgang Dehmel, Markgroeningen (DE); Andreas Kellner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/275,217

(22) PCT Filed: Apr. 26, 2001

(86) PCT No.: PCT/DE01/01572

§ 371 (c)(1),
(2), (4) Date: Jun. 9, 2003

(87) PCT Pub. No.: WO01/83971

PCT Pub. Date: Nov. 8, 2001

(65) Prior Publication Data

US 2004/0020281 A1 Feb. 5, 2004

(30) Foreign Application Priority Data

May 3, 2000 (DE) ..... 100 21 534
Jan. 30, 2001 (DE) ..... 101 03 867

(51) Int. Cl.[7] ..... F02M 59/36
(52) U.S. Cl. ..... 123/458; 123/494; 73/119 A
(58) Field of Search ..... 123/458, 494; 73/119 A

(56) References Cited

U.S. PATENT DOCUMENTS

| | | | | |
|---|---|---|---|---|
| 5,333,583 A | * | 8/1994 | Matsuura | 123/295 |
| 5,499,538 A | * | 3/1996 | Glidewell et al. | 73/119 A |
| 5,715,786 A | | 2/1998 | Seiberth | |
| 5,732,675 A | * | 3/1998 | Yoshida et al. | 123/305 |
| 6,526,947 B2 | * | 3/2003 | Shimada et al. | 123/495 |
| 6,581,574 B1 | * | 6/2003 | Moran et al. | 123/497 |

FOREIGN PATENT DOCUMENTS

| | | | |
|---|---|---|---|
| DE | 195 20 300 | | 12/1996 |
| EP | 0 375 944 | * | 7/1990 |
| EP | 0 501 459 | * | 9/1992 |
| JP | 10 054292 | * | 2/1998 |
| JP | 11 036935 | | 2/1999 |
| JP | 11 036935 | * | 5/1999 |
| WO | WO 01 29411 | | 4/2001 |
| WO | 01 29411 | * | 4/2001 |

OTHER PUBLICATIONS

MTZ Motortechnische Zeitschrift, 58 (1997) No. 10, pp. 572–582.
Patent Abstracts of Japan, vol. 1999, No. 05, May 31, 1999.
Patent Abstracts of Japan, vol. 1998, No. 6, Apr. 30, 1998.

* cited by examiner

*Primary Examiner*—Thomas N. Moulis
(74) *Attorney, Agent, or Firm*—Kenyon & Kenyon

(57) ABSTRACT

A device and a method of monitoring a fuel metering system of an internal combustion engine, in particular a common rail system. The fuel is compressed by a pump, and a pressure variable characterizing the fuel pressure is determined. An error is detected when a filtered pressure variable deviates from a threshold value.

11 Claims, 3 Drawing Sheets

METHOD AND DEVICE FOR MONITORING A FUEL SYSTEM OF AN INTERNAL COMBUSTION ENGINE

FIELD OF THE INVENTION

The present invention relates to a method and a device for monitoring a fuel metering system of an internal combustion engine.

BACKGROUND INFORMATION

German Published Patent Application No. 195 20 300 and U.S. Pat. No. 5,715,786 discuss a method and a device for monitoring a fuel metering system of an internal combustion engine, in particular a common rail system. With such common rail systems, the fuel is compressed by a pump, and a pressure variable characterizing the fuel pressure is determined. A fault in the area of the fuel metering system is detected by monitoring the pressure signal in certain operating states.

Pressure is often generated by high-pressure pumps which are configured in particular as radial piston pumps including at least two to three pump elements. To reduce the pump delivery rate, each of these is provided with an element shutdown valve. A corresponding common rail system is discussed, for example, in the publication MTZ Motortechnische Zeitschrift 58 (1997) no. 10, page 572 ff.

Malfunctions may cause one of the pump elements or an element shutdown valve not to operate properly. Such a pump element failure may not be detected reliably with other monitoring systems. Such a pump element failure is detected reliably only when the pump delivery rate is no longer adequate to cover the quantity of fuel to be injected. This is the case in particular only when large quantities of fuel are injected.

SUMMARY OF THE INVENTION

With the exemplary method according to the present invention, a defect in the pump, in particular a failure of one or more pump elements, may be detected regardless of the operating point of the engine. This is achieved by analyzing a filtered pressure variable. When a fault is detected, the filtered pressure variable may deviate from a certain threshold value.

Filtering may be performed in such a manner that frequencies which are in a certain ratio to the rpm of the engine are selected or the filtering may be performed in such a manner that frequencies corresponding to an integral multiple of a pump frequency are selected. This permits a method of detecting fluctuations in pressure due to the fact that one pump element is not delivering.

In an exemplary embodiment, a fault in the area of the element shutdown valve and of the pump may be differentiated based on a triggering signal for an element shutdown valve. This is achieved through an appropriate plausibility check of the triggering signal for the element shutdown valve and the filtered pressure signal. If the filtered pressure signal indicates that one pump element is not delivering, then a fault is detected only if the triggering signal assumes a value for the element shutdown valve which is not characteristic of an element shutdown valve that has not been shut down. If the filtered pressure signal indicates that all pump elements are delivering, then a fault is detected when the triggering signal for the element shutdown valve assumes a value characterizing an element shutdown valve that has been shut down.

A defect in the pump and a defect in another component may be differentiated, in particular a pressure regulating valve, by using this method. This allows for assignment of faults that occur and are detected by other methods to individual components of the system with a high reliability. In particular, faults in the pump area may be differentiated reliably from faults in other components.

The present invention is explained below on the basis of the exemplary embodiments illustrated in the drawings.

DETAILED DESCRIPTION

Figure 1:
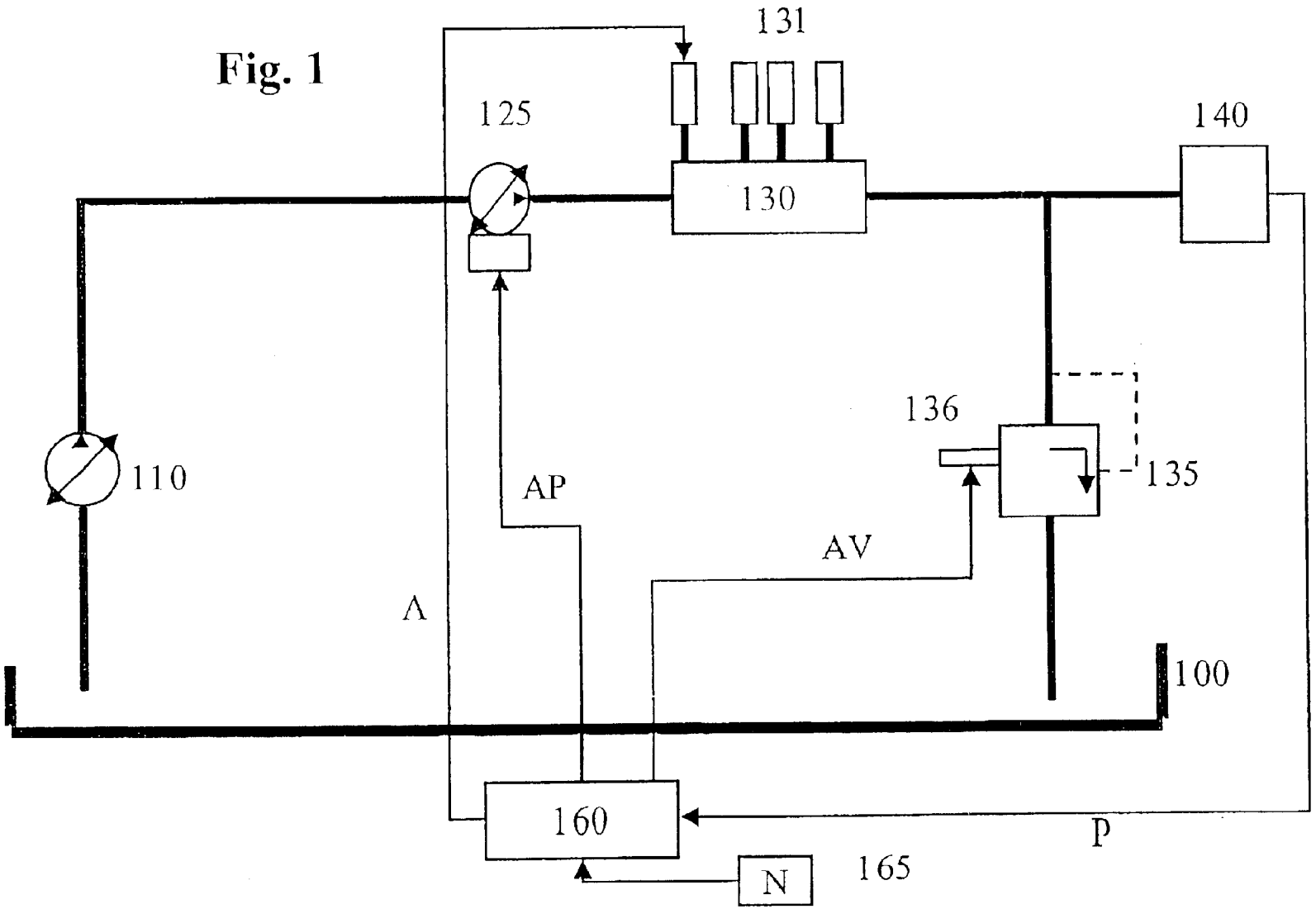
FIG. 1 shows a block diagram of the exemplary fuel metering system according to the present invention.

FIG. 1 shows the components of a fuel supply system of an internal combustion engine having high-pressure injection. The system shown here is also referred to as a common rail system.

A fuel supply tank 100 is connected to a high-pressure pump 125 by a presupply pump 110. High-pressure pump 125 may include at least one element shutdown valve. High-pressure pump 125 is connected to a rail 130. Rail 130 is also referred to as a reservoir and is in contact with various injectors 131 via fuel lines.

Pressure P in the rail, i.e., in the entire high-pressure area, is determined by sensor 140. Rail 130 is connected to fuel supply tank 100 by a pressure regulating valve 135. Pressure regulating valve 135 is controllable by a coil 136.

A control unit 160 sends a triggering signal AP to element shutdown valve 126, a triggering signal A to injectors 131 and a signal AV to pressure regulating valve 136. Control unit 160 processes various signals from various sensors 165 which characterize the operating state of the engine and/or the vehicle driven by the engine. Such an operating state is, for example, rotational speed N of the engine.

This device operates as follows. Fuel from the storage tank is conveyed by presupply pump 110 to high-pressure pump 125.

High-pressure pump 125 conveys fuel from the low-pressure area into the high-pressure area. High-pressure pump 125 builds up a very high pressure in rail 130. In systems for internal combustion engines operated with spark ignition, pressure values of approximately 30 to 100 bar may be achieved, and pressures of approximately 1000 to 2000 bar are achieved in compression-ignition engines. The fuel may be metered under a high pressure to the individual cylinders of the engine through injectors 131.

Pressure P in the rail, i.e., in the entire high-pressure area, is determined by sensor 140 and compared with a setpoint value in control unit 160. Pressure regulating valve 135 is controlled as a function of this comparison. When demand for fuel is low, the delivery of high-pressure pump 125 may be reduced incrementally through appropriate triggering of the element shutdown valve.

The high-pressure pump rotates at a fixed transmission ratio I to the crankshaft of the engine. The pressure is detected in the control unit in synchronization with the rotational speed. In the event of a pump element failure, the plot of the rail pressure over time shows a characteristic dip which occurs with the pump frequency. The pump frequency is filtered out of the rail pressure signal by a digital bandpass filter.

To do so, the pressure signal is sampled in synchronization with the rotational speed at at least twice the pump frequency, at at least four times the pump frequency. The rail pressure is sampled equidistantly 2Z times, Z is the number of cylinders, per crankshaft revolution.

The bandpass-filtered rail pressure signal is then rectified and lowpass filtered again in synchronization with the rotational speed. The output signal of this signal processing is a measure of the pressure oscillations at the pump frequency. If the signal filtered in this manner exceeds a threshold value, the pump delivers on only two elements or even on one element instead of three elements.

The functioning of an element shutdown valve which deactivates a pump element may be monitored.

On detection of a pump element failure, additional pump damage and engine damage is prevented by suitable emergency responses. The rail pressure and/or the fuel quantity and/or the engine rpm may be limited to a lower value than in normal operation. In addition, the driver may be informed of the emergency operation by a warning lamp, so that he may take the vehicle to a repair shop. In addition, the pump error is entered into an error memory. This simplifies the error diagnosis.

Figure 2:
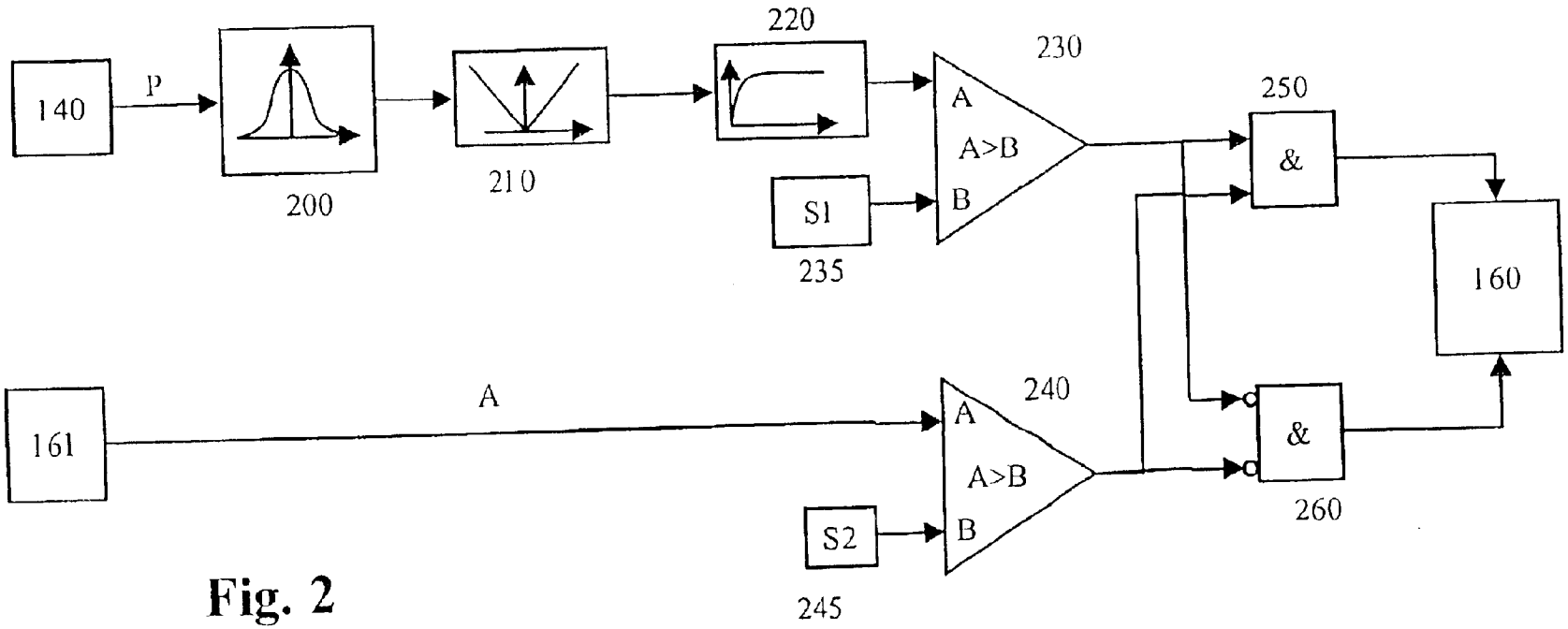
FIG. 2 shows a block diagram of the monitoring according to the present invention.

FIG. 2 shows the exemplary method according to the present invention on the basis of a block diagram. Elements already described in FIG. 1, such as the pressure sensor, are shown with corresponding reference notation. The device shown here forms part of control unit 160. Output signal P of pressure sensor 140 goes through a bandpass filter 200 to an absolute value forming unit 210 whose output signal goes through a lowpass filter 220 to a first input a of a first comparator 230. Output signal S1 of a first threshold value preselector 235 is applied to second input b of first comparator 230. The arrangement of lowpass filter 220 has been selected only as an example, and the filter may also be arranged at any other location between sensor 140 and comparator 230.

The output signal of a pump trigger unit 161, representing a part of control unit 160, goes to a first input a of a second comparator 240 at whose second input b output signal S2 of a second threshold value preselector 245 is applied. The output signals of comparators 230 and 240 are each sent to a first AND element and, inverted, to a second AND element 260, which in turn send corresponding signals to control 160.

This device functions as follows. Output signal P of the pressure sensor goes to bandpass filter 200. Bandpass filter 200 is configured so that it filters out frequencies which correspond to the pump revolution or to an integral multiple of the pump rotational speed. Absolute value-forming unit 210 rectifies the signal. Lowpass filter 220 smooths the signal. If comparator 230 recognizes that the signal filtered in this manner is greater than threshold value SI, the comparator detects an error.

This signal may be subjected to a plausibility check with a signal which indicates that a pump element is shut down, i.e., one element shutdown valve is appropriately triggered. This signal is supplied by second comparator 240. To do so, triggering signal A for element shutdown valve 126 is compared with second threshold value S2. If signal A is larger than the second threshold value, i.e., the element shutdown valve is receiving a triggering signal such that it is not usually activated, then a signal indicating that the element shutdown valve has not been activated appears at the output of the comparator. This signal is associated with the output signal of comparator 230 in AND element 250, i.e., comparator 230 delivers a signal which indicates that pressure fluctuations are occurring with a certain frequency, and if the output signal of second comparator 240 indicates that an element shutdown valve is not activated, AND element 250 and thus the device detects failure of a pump element.

Furthermore, the two signals are inverted and sent to second AND element 260, which detects a defect in the element shutdown valve if no pressure fluctuations occur and the output signal of second comparator 240 indicates that an element shutdown valve is activated.

In an exemplary embodiment, elements 200, 210, 220, 230 and 235 are sufficient. In this case, the possibility of the test being performed with the element shutdown valve shut down is ruled out by an external logic in the area of control unit 160. The same thing is also true if no element shutdown valve is provided. In these cases, the device will provide only a signal which indicates that a pump element is not operating.

In common rail systems, the rail pressure is checked for plausibility. If an implausibility occurs in driving operation, this will result in the driven engine being shut down. If such an implausibility is detected before startup or at the time of the startup, e.g., because the rail pressure does not rise to an expected level, then the engine will not start. The cause of this error is not readily discernible. Such an error may be based on the fact that an error has occurred in the area of the high-pressure pump or that an error has occurred in the area of pressure regulating valve 135. Troubleshooting is therefore very complex in part. Therefore, according to the present invention, starting with the exemplary method described in FIG. 2, different errors may be differentiated.

The ability to differentiate between errors permits a better diagnosis and thus simplified troubleshooting. In addition, in an exemplary embodiment errors may be detected when they are about to occur and corresponding measures may be initiated.

FIG. 3 illustrates a corresponding method. According to the present invention, on the basis of the pressure fluctuations detected, not only are errors detected but also the type of error, on the basis of the pressure oscillations, is detected.

Figure 3A:
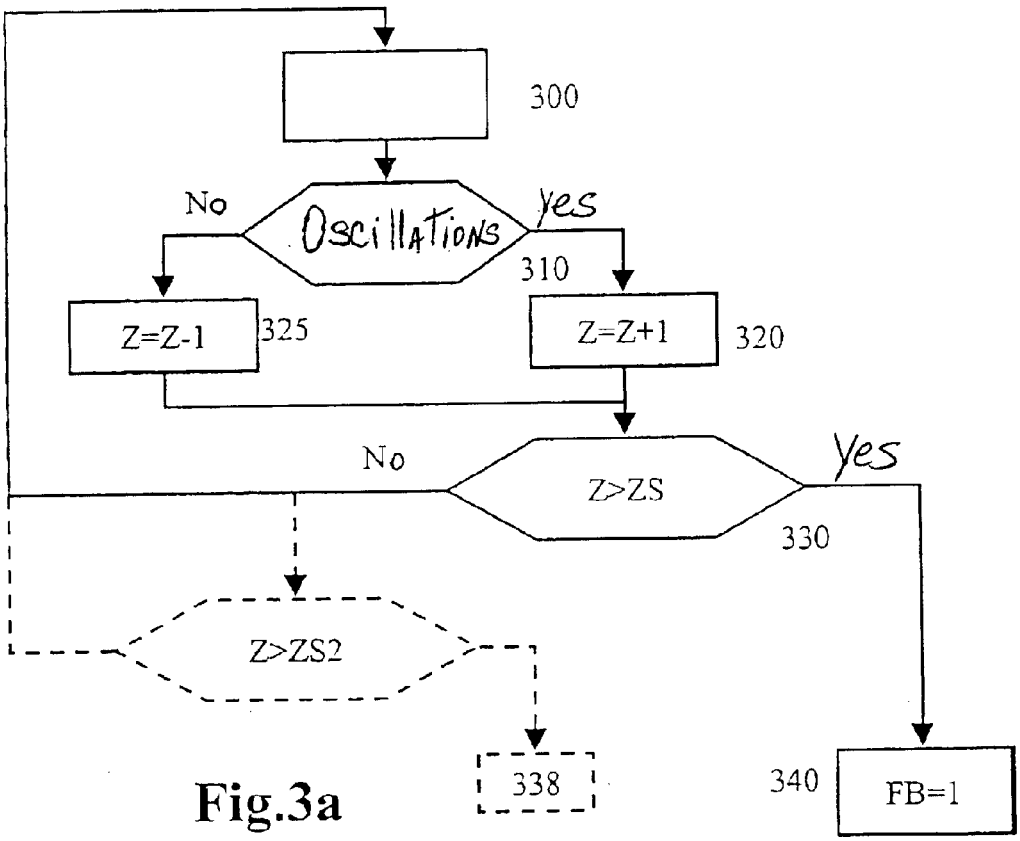
FIG. 3 shows a flow chart of the exemplary method according to the present invention.
Figure 3B:
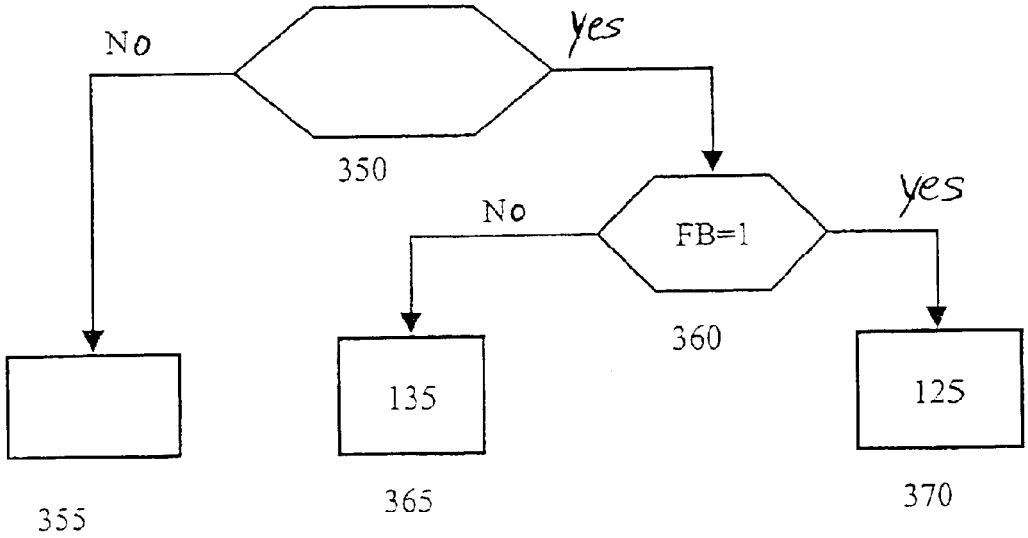

FIG. 3*a* illustrates a method by which pressure oscillations are detected and a corresponding error bit is set. FIG. 3*b* shows how the type of error is detected on the basis of the pressure oscillations detected.

The rail pressure is analyzed in a first step 300. To do so, the rail pressure is filtered with bandpass filter 200. The frequency of the bandpass depends on the number of cylinders of the engine, the transmission ratio between the crankshaft and the pump and the number of pump elements of the pump. This frequency is applied in a customer-specific manner. Accordingly, threshold values S1 of threshold value preselector 235 are preselected so that the usual fluctuations in the rail pressure do not result in detection of errors. The check is performed only in certain rpm ranges. The check is performed only at an rpm below a preselectable rpm threshold.

Subsequent query 310 checks on whether rail pressure oscillations having a significant period have been detected. If this is the case, then in step 320 a counter Z is incremented. If no oscillations are detected, the counter is decreased by a certain value in step 325. Following steps 325 and 320, a query 330 is issued to check on whether counter Z is greater than a threshold value ZS. If this is the case, then in step 340 an error bit FB is set at 1. Otherwise the program continues with step 300.

If an error is detected in step 350 on the basis of a rail pressure implausibility or another error check, then a check is performed in step 360 to determine whether error bit FB has been set at 1. If this is the case, then in step 370 an error of pump 125 is detected. If this is not the case then in step 365 an error of pressure regulating valve 135 is detected. If query 350 recognizes that there is no error, the program continues with step 355 in normal operation.

In step 350, errors within the context of implausibility in ongoing operation as well as an error in startup of the engine are detected.

In an exemplary embodiment of the method according to the present invention which is illustrated with dotted lines in FIG. 3*a*, another query 335 is issued after query 330, checking on whether counter Z is greater than a second threshold value ZS2. This value ZS2 is considerably smaller than value ZS. This value ZS2 indicates that an error might have occurred in the area of high-pressure pump 125, because pressure fluctuations are occurring at an increased frequency. If this is detected, substitute responses and emergency operating methods, e.g., limiting fuel quantity and/or limiting rail pressure may be implemented even before shutting down the engine. These measures are then implemented in step 338.

What is claimed is:

1. A method of monitoring a fuel metering system of an internal combustion engine, comprising:

compressing a fuel by a pump;

determining a pressure variable characterizing a fuel pressure;

detecting an error when a pressure variable filtered with a bandpass filter and a low pass filter deviates from a threshold value, wherein a plurality of frequencies of the bandpass filter and the low pass filter are selected to be in a certain ratio to an engine rpm.

2. A method of claim 1, wherein the fuel metering system is a common rail system.

3. The method of claim 1, wherein the plurality of frequencies includes frequencies corresponding to an integral multiple of a pump frequency.

4. The method of claim 1, wherein an error in an area of an element shutdown valve is differentiated from a second error in an area of the pump on basis of a triggering signal for the element shutdown valve.

5. The method of claim 1, wherein an absolute value of a filtered signal is compared with a second threshold value.

6. The method of claim 5, wherein the filtered signal is filtered by the lowpass filter.

7. The method of claim 1, wherein in a defect in the pump is detected.

8. The method of claim 1, wherein a defect in the pump is differentiated from a defect in a component.

9. The method of claim 8, wherein the component is a pressure regulating valve.

10. A device for monitoring a fuel metering system of an internal combustion engine, comprising:

a pump to compress a fuel;

an arrangement to detect an error when a filtered pressure variable deviates from a threshold value;

wherein the filtered pressure variable is filtered with a bandpass filter and a low pass filter, and a plurality of frequencies of the bandpass filter and the low pass filter are selected to be in a certain ratio to an engine rpm.

11. The method of claim 10, wherein the fuel metering system is a common rail system.

* * * * *